US011490674B2

(12) United States Patent
Shwarts

(10) Patent No.: US 11,490,674 B2
(45) Date of Patent: Nov. 8, 2022

(54) BAREFOOT SANDAL SOCKS

(71) Applicant: Rosalia Shwarts, Summerville, SC (US)

(72) Inventor: Rosalia Shwarts, Summerville, SC (US)

( * ) Notice: Subject to any disclaimer, the term of this patent is extended or adjusted under 35 U.S.C. 154(b) by 137 days.

(21) Appl. No.: 16/839,359

(22) Filed: Apr. 3, 2020

(65) Prior Publication Data

US 2021/0052031 A1 Feb. 25, 2021

Related U.S. Application Data

(60) Provisional application No. 62/888,796, filed on Aug. 19, 2019.

(51) Int. Cl.
*A43B 3/12* (2006.01)
*A43B 1/00* (2006.01)

(52) U.S. Cl.
CPC ..... *A43B 3/12* (2013.01); *A43B 1/0018* (2013.01)

(58) Field of Classification Search
CPC .. A43B 3/12; A43B 3/16; A43B 3/163; A43B 1/0018; A43B 17/02; A43B 17/102; A43B 3/244; A43B 17/12
USPC ..... 36/11.5
See application file for complete search history.

(56) References Cited

U.S. PATENT DOCUMENTS

| | | | | |
|---|---|---|---|---|
| 4,850,122 | A * | 7/1989 | Schwab, Jr. | A43B 3/20 36/7.1 R |
| 6,209,227 | B1 * | 4/2001 | Swango | A43B 3/16 36/7.1 R |
| 7,210,251 | B1 * | 5/2007 | Rolle | A43B 1/0081 36/15 |
| 8,789,297 | B1 * | 7/2014 | Doyle | A43B 3/163 36/130 |
| 2005/0097781 | A1 * | 5/2005 | Greene | A43B 3/122 36/101 |
| 2008/0052966 | A1 * | 3/2008 | Pan | B29D 35/122 36/8.1 |
| 2016/0015128 | A1 * | 1/2016 | Cazarez | A43B 17/105 36/43 |
| 2017/0142958 | A1 * | 5/2017 | McDaniel | A43B 3/16 |
| 2019/0029389 | A1 * | 1/2019 | Levy | A43B 3/12 |
| 2021/0153597 | A1 * | 5/2021 | Williams | A43B 3/16 |

* cited by examiner

*Primary Examiner* — Timothy K Trieu
(74) *Attorney, Agent, or Firm* — Smith, Gambrell & Russell, LLP.

(57) ABSTRACT

An aesthetically pleasing sandal sock with an upper planar surface and with a lower surface on which is located an oval structure with an opening and sides capable of engaging with the outer edges of the sandal sole, principally the outer edge of a toe region of the sandal and the outer edge of heel region of the sandal, such that the upper planar surface of the sock extends the length and width of the sandal sole. The sandal sock is composed of elastic and flexible material. The side of the oval opening has an outer edge and an inner edge. The inner edge connects and binds with the lower surface. The outer edge is capable of contacting the outer edge of the sandal to position and hold the upper planar surface of the sock so that it is in contact with both upper surface of the sandal sole and foot, when the sandal is worn. The sandal enjoys a naked foot look when worn.

5 Claims, 7 Drawing Sheets

Front view

Back heel view side view overhead view

BAREFOOT SANDAL SOCKS

CROSS-REFERENCE TO RELATED APPLICATIONS

This application is based on provisional application No. 62/888,796 filed Aug. 19, 2019, to which priority is claimed. The contents of the application are expressly incorporated herein by reference.

BACKGROUND OF THE INVENTION

Field of Invention

This invention generally relates to footwear and, more specifically, to a sock which is specifically adapted for use with sandal type footwear to promote foot heath and sandal aesthetics—the bare foot look.

Background of the Invention

Sandals have been gaining in popularity and come in a variety of styles. Common to most sandal styles is moisture associated with sweat and friction associated with day to day wearing and, in particular, the break-in-period, which can lead to sores, blisters or skin irritation. Socks have provided solutions to these problems by absorbing moisture and minimizing friction. However, the presence of the visible sock or portion thereof detracts from the naked foot look, a problem for some. The naked foot is prized by sandal wearers, especially, in the summer months when aesthetics and comfort are highly prized. Aesthetics are especially highly prized for thongs—flip flops—and strapped sandals—open toe and heel versions. The thong sandals present an additional problem when closed toe-end socks are desired. The presence of the thong is accommodated by the inclusion of a slit in the sock.

A strap sandal permits the foot movement, even when a heal strap is provided, which gives rise to friction and skin irritation. Socks can lessen the effects of the back and forth movement of the foot. However, the presence of the sock of even a visible portion thereof detracts from the naked foot look and the aesthetically pleasing appearance of the sandal generally.

Affixing the sock to a sandal presents an additional design issue relative to its ease of removal and frequent washing. Odor build-up in the sock is typically addressed by frequent washing or even disposal of the sock, e.g. JP 20077325898.

Additionally, a washable composite insole has been developed to provide support and address sweat buildup by permitting frequent washing, e.g. U.S. Pat. No. 9,560,896 and US 2011/0283562. The insole does present sandal attachment issues.

The aesthetics issue has typically been addressed by minimizing sock visibility, e.g. US 20120255101 and U.S. Pat. No. 5,867,838. As noted earlier, a sock slit is employed to accommodate the thong, e.g. U.S. 2016/0088878 A1 and US 2004/0261290.

Objects and Advantages

The socks of the invention are aesthetically pleasing and promote foot health by controlling moisture build up. The socks cover the upper surface of the sandal and overlap with the front toe edge and heel region edge of the sandal. The socks are in direct contact with the sole of the foot. This positioning of the sock on the sandal avoids exposure and does not detract from the aesthetically pleasing design of the sandal.

The socks of the invention are easily removed from the sandal and washed no different from a typical ankle sock. This ease of removal allows for frequent cleaning. This not only addresses the odor issue but also extends the lifetime of the sandal. The sandal sock of the invention promotes foot health and sandal life.

SUMMARY OF THE INVENTION

A sandal sock has a planar upper surface and a lower surface that has located on it an oval cavity with elastic sides that is capable of accommodating an upper sandal surface and its edges. The elastic sides provide a region of sufficient size to contact the edge of the upper portion of the sandal to position and hold the sock in place over the entirety of the upper sandal surface. This placement results in the upper planar sock surface extending from the toe region of the sandal to the heel region. The sock covers the entire upper surface of the sandal where the sole of the foot is placed. The sandal sock is composed of a flexible and elastic knit material that, when extended over the sole of the sandal, is in continuous contact with the upper surface and the edges of the opening, which is oval in shape. The front and rear oval edges, respectively, are placed on the sandal edges of the toe and heel regions. The order of initial placement is not critical so long as the sock is secured. The degree of oval edge placement on the sandal edge should be sufficient to hold the elastic sock material in place so that it is contiguous with the upper surface of the sandal, during use. The flexible material can be a single contiguous material or be composed of discrete materials that are connected so that the covering is contiguous over the sandal surface. The oval opening has a perimeter (circumference) sufficient in size to permit a sandal to be inserted and to contact the edge of the toe region and the edge of the heel region of the sandal. The contact with the edges of the opening is sufficient to stretch the elastic sock material over the entire sole surface of the sandal and hold the sock in place while the sandal is worn.

The flexible material is typically composed of a knitted textile fabric manufactured with a variety of elements polyester, nylon, cotton, lycra, and gels. The elements may be selected to impart stretch-resistance, wearability, flexibility, air permeability, comfort, and moisture wicking, provide stretch and recovery properties. Other materials can be used. The flexible material is capable of wicking moisture from the surface of the foot into the body of the sock. The material is also of sufficient thickness to avoid moisture build up at the surface and to minimize irritation.

The sandal straps hold the foot in place. The sock is secured to the sandal by the elasticity of the sock material and its contact with the edges of the sandal, principally the sandal edges associated with the heel and toe regions of the sandal. The edge positioning keep the sock in place on the upper sandal and promotes contact with the sole of the foot to dissipate moisture from the foot surface.

The sock is readily removable from the sandal so that frequent washing or disposal is possible.

Some sandal types include a thong that fits between a person's toes. The sock would need to include a slit, recess or similar structure to accommodate the thong. The slit structure can be a stitched recess between the big toe and second toe to accommodate a thong sandal strap. Such structures would permit the use of the sock with that sandal type.

Sandal socks can be shaped to fit a generic shape of the sandal or sized to fit more closely with a specific brand and design of sandal. The sock can be manufactured to correspond to a specific sandal size, e.g. small, medium or large.

The invention also includes methods of making and using sandal socks.

Important to the manufacture of the sandal sock is the formation of a region having elasticity that includes the edge surrounding the opening present on the lower portion of the sock. The material from which the sock is made is flexible and has sufficient elasticity to maintain it shape when used. A process for making the sandal sock includes one or more steps for fashioning the material into a sock structure. The structure has a continuous upper planar surface sized to cover a sandal surface. The material forming the upper surface can be contiguous with the material that forms the lower surface or separately formed and pieced together from the same or different materials.

An opening is formed on the lower sock surface and is sized to accommodate the sole of a sandal. The size of the opening is adjustable so that it expands to provide continuous or partial contact with the outer edges of the sandal sole. Contact with these edges is sufficient to secure the sock to the sandal when worn. The contact results from the elasticity present in the boundary region. This elasticity can result from the selection of the material or the introduction of elastic thread or fibers to the boundary region during the manufacturing process.

The elasticity of the boundary region is sufficient if it imparts to the perimeter of the opening enough flexibility and grip to position and hold the upper surface of the sock on the upper sandal surface. The amount of grip force needed is expected to vary with sandal type and size. Also, the sock size and opening size is expected to vary with sandal type. Standardization of the grip force is expected based for a given sandal size, e.g. large, medium, small, using trial and error experimentation.

The sock can be affixed to the sandal sole in a variety of ways. Typically, the opening is positioned on the sandal so that an edge associated with a toe or heel region of the sock is contacted with the corresponding portion of the sandal and expanded to cover the sole and secured at the opposite side of the opening to the corresponding heel or toe portion so that the upper planar surface of the sock is flat and covers the length and width of the sandal sole. The edge contact is sufficient so that, when worn, contact of the sock with both the sole of the foot and the upper surface of the sandal is maintained.

The adjustment is also possible by the presence of one or more fasteners that permit the selection of a desired size.

DETAILED DESCRIPTION OF THE INVENTION

Figure 1:
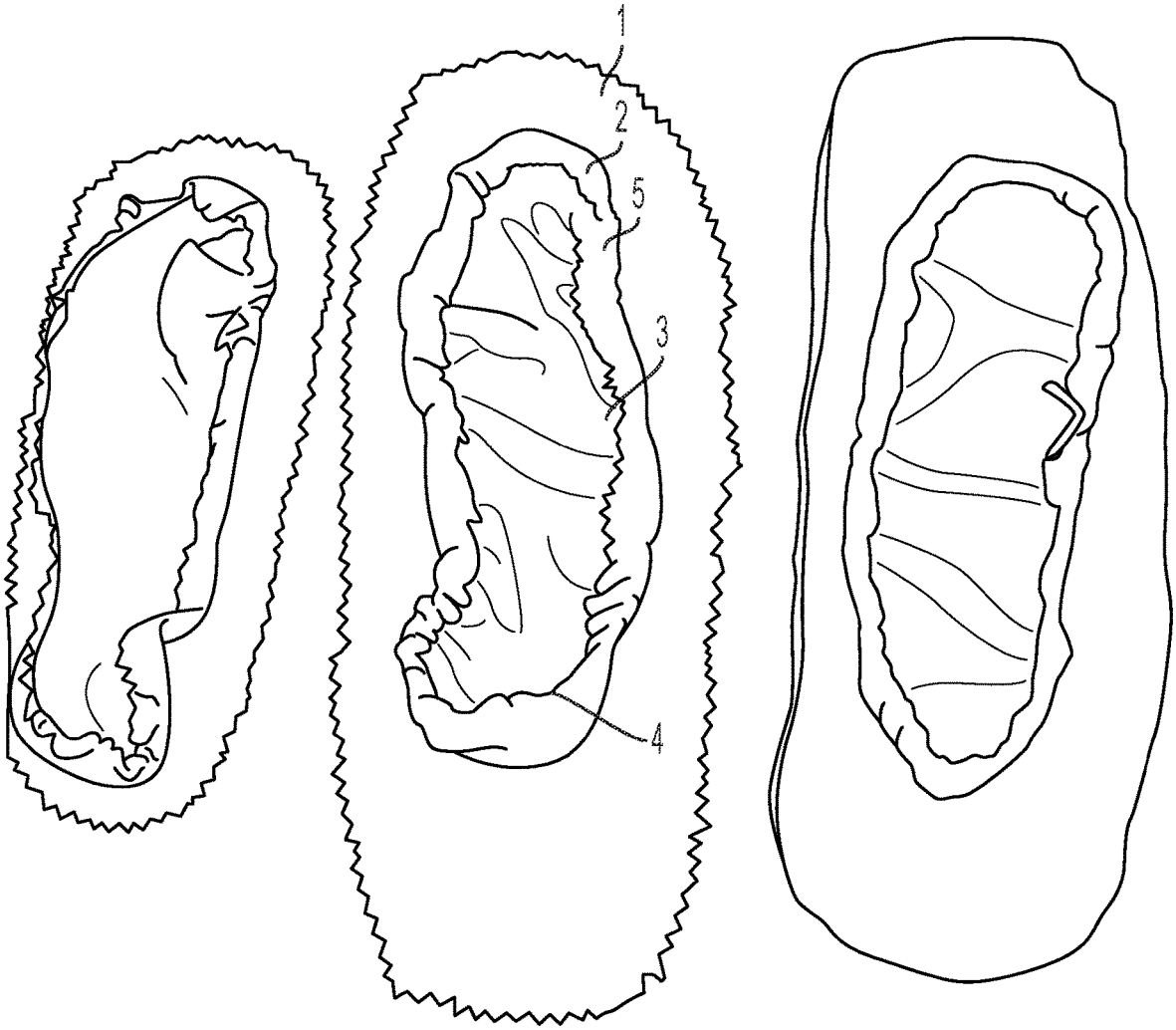
FIG. 1 shows a bottom view of the sandal sock showing a lower surface with an oval opening (cavity) having elastic sides, where the oval opening has a toe region (front), heel region (rear), where the size accommodates the upper surface of sandal, including the edge or portion thereof. An elastic band can be positioned on the circumference of the oval opening, if desired.

FIG. 1 shows a bottom view of the sandal sock (1) having a toe region (2), an adjustable opening (3) for receiving the upper surface of a sandal and a heal region (4). An elastic band (5) can be secured along the perimeter of the oval opening to permit adjustment of the size of the oval opening. The sandal is secured within the sock by the elasticity of the material that forms the sock (1) and the contact of the oval opening edges with the sandal edges.

Figure 2A:
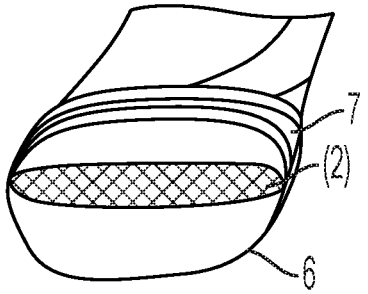
FIG. 2 (*a*) shows a front view; (*b*) shows a back heel view and (*c*) shows a side views of an open toe (front) and heel (rear) sandal where a sock is positioned on the sandal surface and extends from the front sandal edge of the toe region to the rear heel sandal edge. As depicted in the front view (*a*) and the rear view (*b*) is a sandal edge overlap that holds the sock in place so that the upper planar surface of the sock extends over the upper sole surface of the sandal.
Figure 2B:
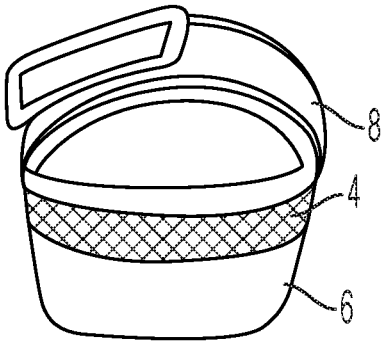
Figure 2C:
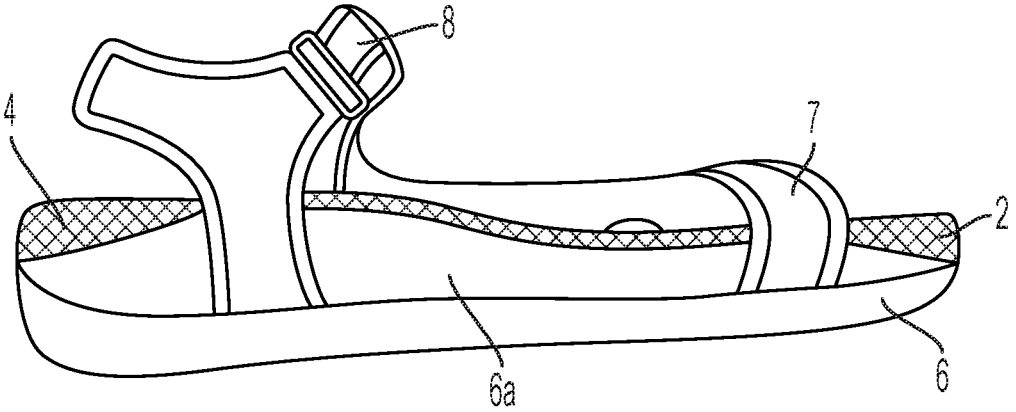

FIG. 2 (*a*) provides a front view of the sandal (6) that shows the sock edge overlap associated with the sock toe region (2) and also shows the frontal strap (7). FIG. 2 (*b*) shows a back heel view of the sandal (6) and shows the ankle strap (8). The sock overlap with the edge associated with the heel portion (4) of the sock is also shown. FIG. 2 (*c*) shows a side view of the sandal (6) with the front (7) and ankle (8) straps. The side view of the sock includes the toe (2) and heel (4) regions. The toe region edge sock overlap and the heel region edge overlap, as depicted, illustrate the tension on the elastic material that causes the material to be contiguous with the upper surface (6*a*) of the sandal. The sock-sandal absorbs moisture from the foot surface. The wicking action of the sock material removes the moisture from the sock-foot sole interfaces which creates and maintains a dry environment. As depicted in FIGS. 2(*a*) and 2 (*b*), are the edge overlaps, toe and heel regions that position and hold the sock in place so that the planar upper surface extends over the upper surface of the sandal surface, e.g. the overlap extends a quarter of the distance from the upper surface of the sandal to the bottom edge of the sole, where the sandal contacts the ground. The thickness of the sole can be a quarter inch thick; the overlap would then be about a sixteenth of an inch. The necessary overlap is dependent on a variety of factors. The positioned sock minimizes friction and skin irritation. The overlap of the sock on the edges is in sufficient contact with the sandal edge to maintain placement of the sock on the upper surface of the sandal sole during walking or any level of movement.

Figure 3:
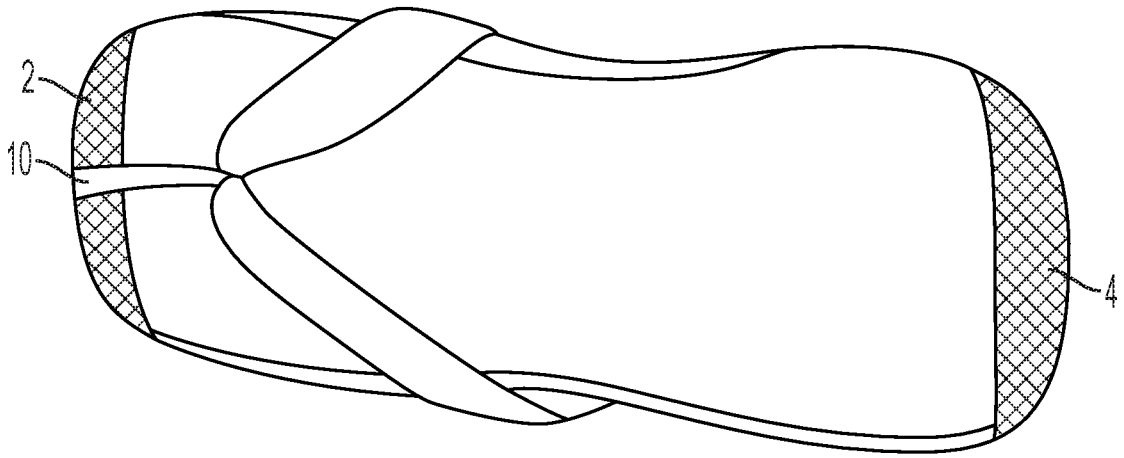
FIG. 3 shows an overhead side view of a thong sandal where the sock is situated on the upper sandal surface and has a recess to accommodate the thong. The shaded portions are the edge sock overlaps.
Figure 5:
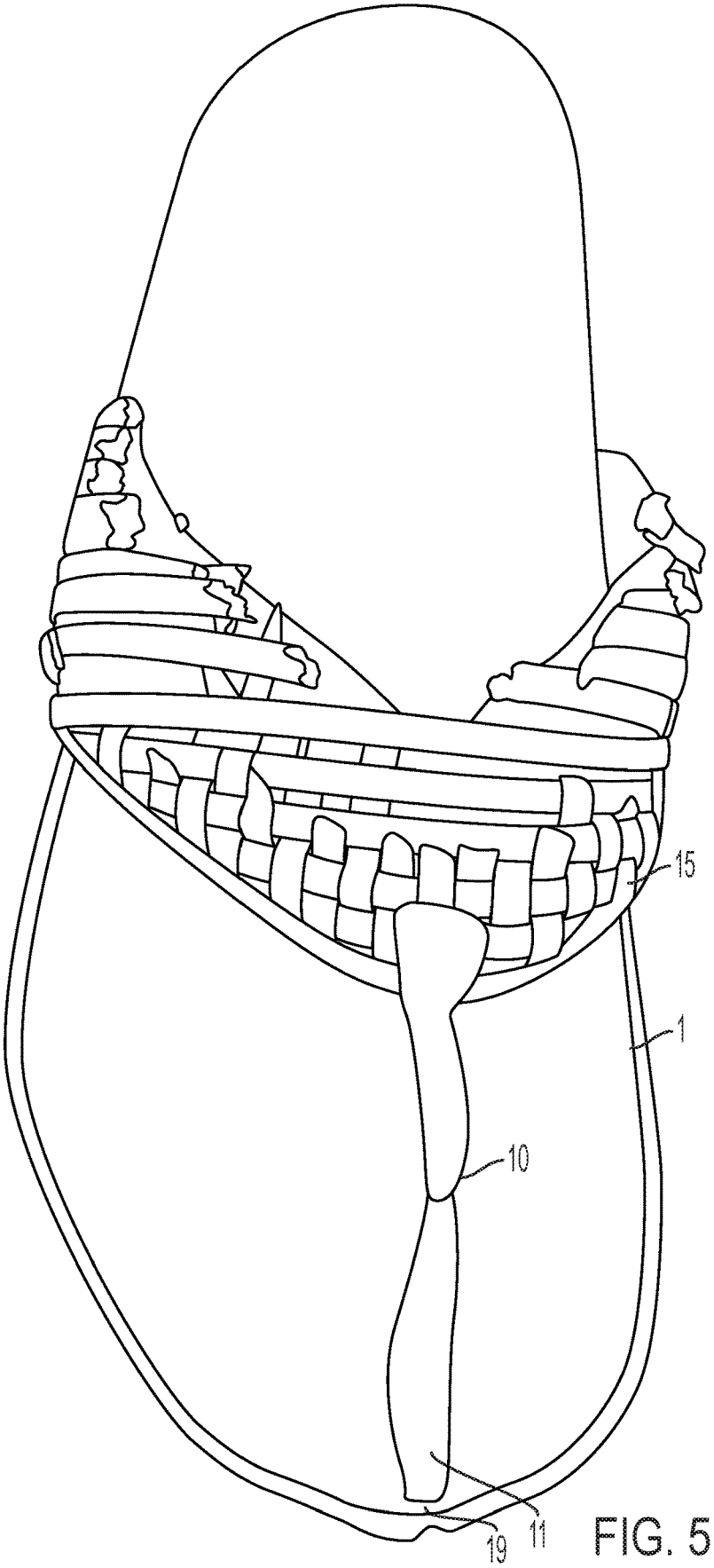
FIG. 5 shows a top view of a thong sandal with a sandal sock having a recess for the thong and a Velcro fastener that provides for recess closure, when engaged.

FIG. 3 shows an overhead view of the thong sandal embodiment and sock. The thong strap (10) is shown in relation to toe and heel regions of the sock. The ankle strap (8) and opening (3) are not shown. The open toe sandal sock and thong sandal embodiments are shown in FIG. 5. Depicted in the thong sandal embodiment is the stitched recess (11) and fastener (12).

Figure 4A:
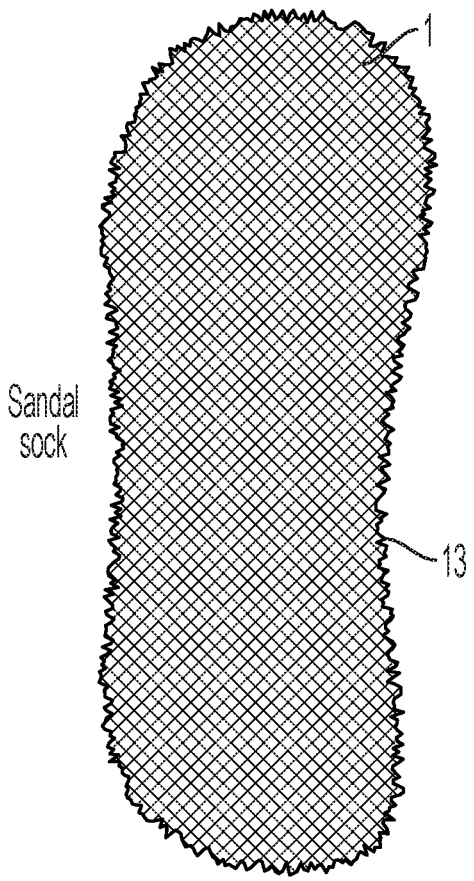
FIG. 4 (*a*) shows a sandal sock positioned on an open toe and heel sandal and (*b*) shows a sandal sock positioned on a thong sandal with a stitched recess and fastener for the thong of the sandal.
Figure 4B:
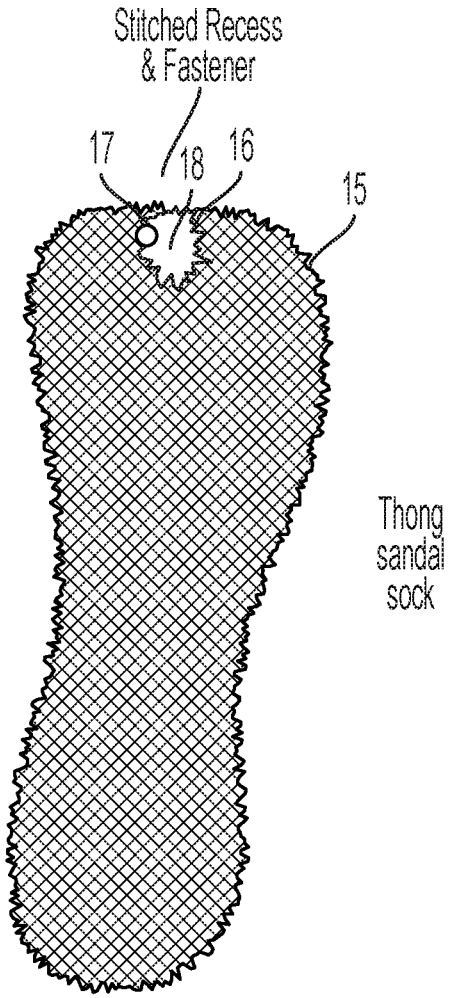

FIG. 4 (*a*) shows a sandal sock (1) positioned on the upper sole of an open toe and heel sandal (13) and a sandal sock (1) positioned on the upper sole surface (14) of a thong sandal (15) with a stitched recess (16) and fastener (17) for the thong (18) of the thong sandal.

FIG. 5 shows a photograph of a top view of a thong sandal (15) with a sandal sock (1) having a recess (11) for receiving the thong strap (10) and a Velcro tab (19) for closing the open recess after placement of the thong strap (10).

Figure 6:
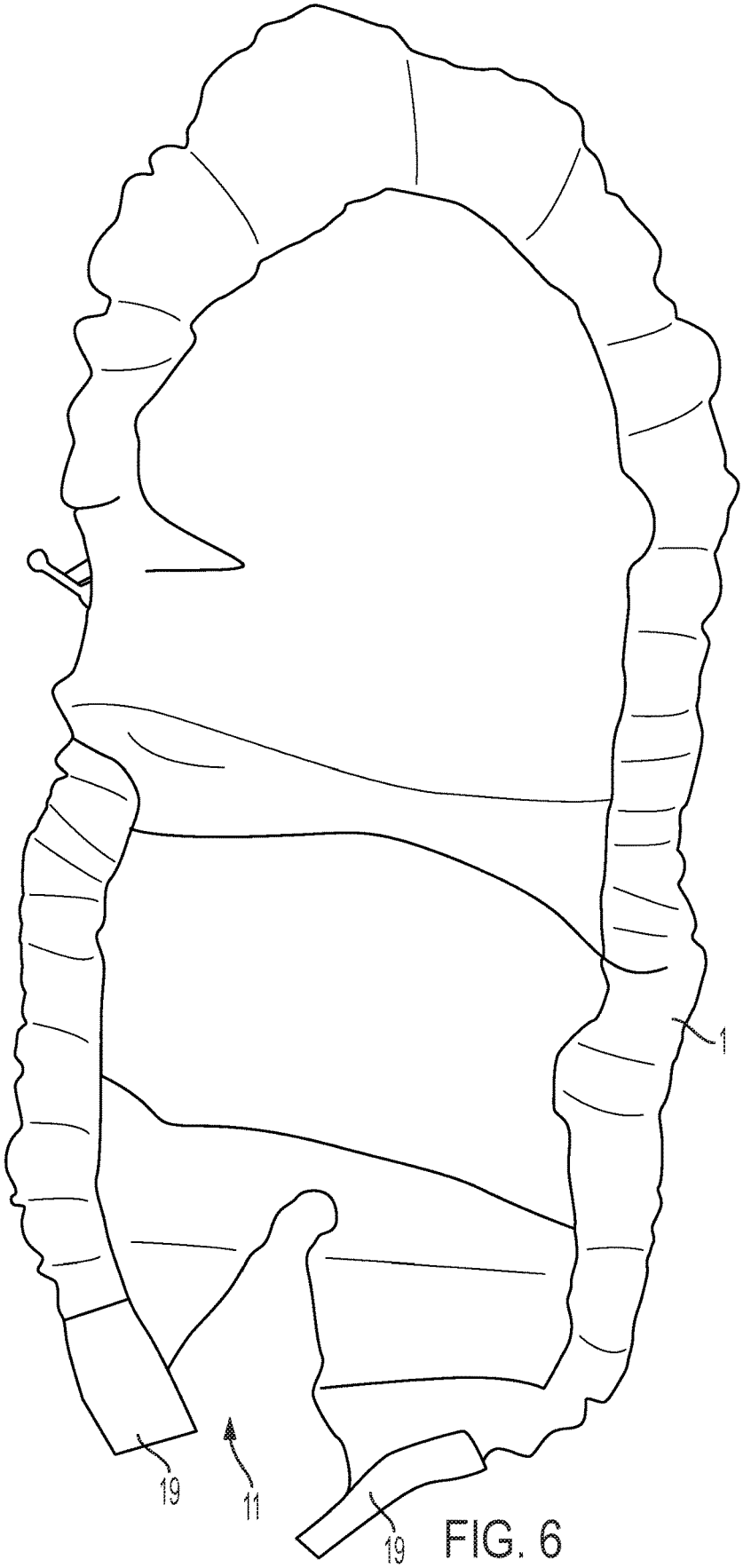
FIG. 6 shows an upper view of the sandal sock with a recess where Velcro tab is disengaged and the recess is in an open position.

FIG. 6 shows a photograph of an upper view of the sandal sock (1) with a recess (11) and open ends of the disengaged Velcro tab (19) used for closure.

Figure 7:
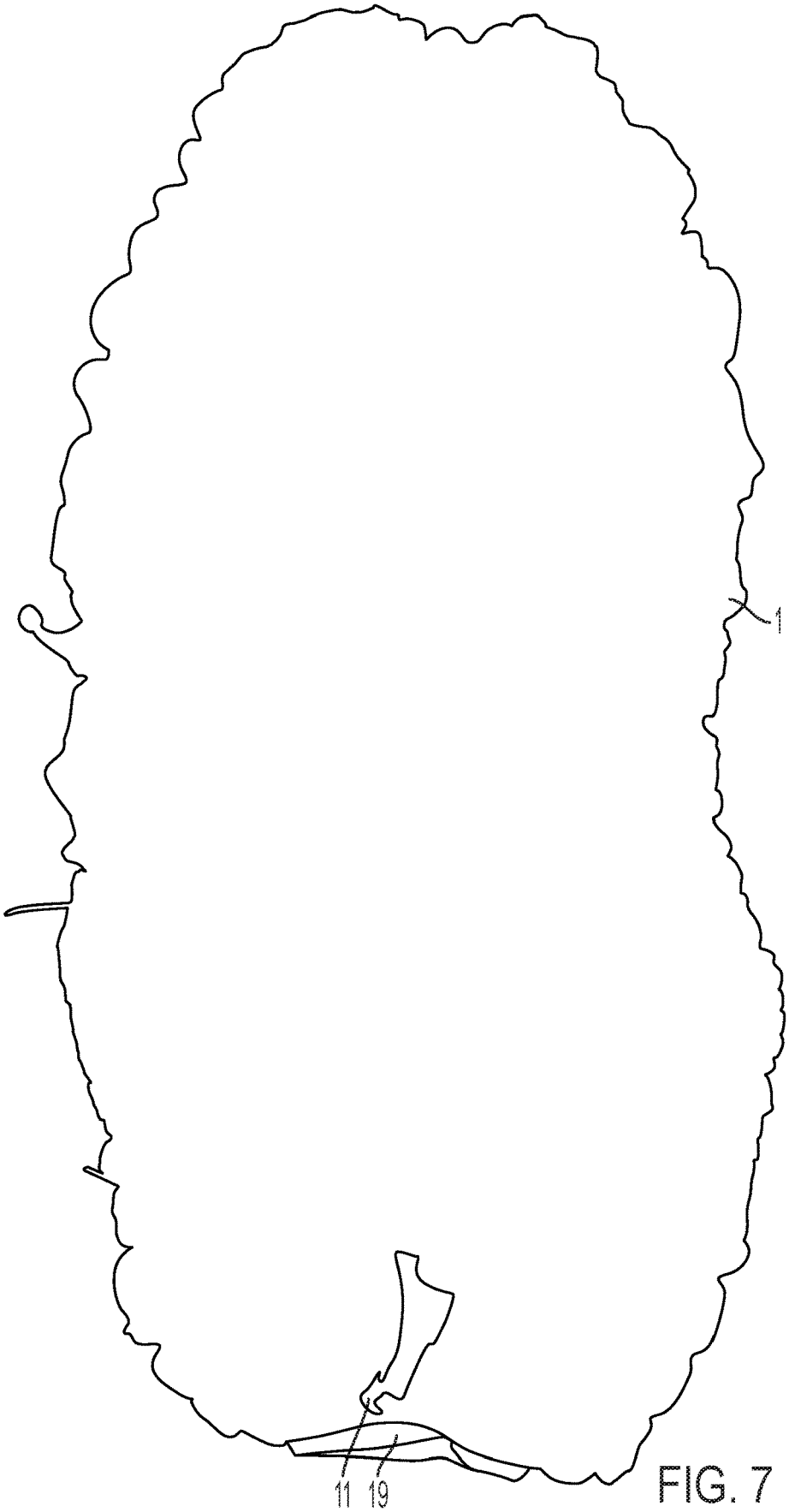
FIG. 7 shows an upper view of the sandal sock where the recess is closed and the opposite surfaces of the Velcro tab are engaged.

FIG. 7 shows a photograph of an upper view of the sandal sock (1) with a recess (11) in a closed position achieved by contacting the respective sides of the Velcro tab (19).

The sandal sock (1) is positioned on the upper surface of the sandal sole (6*a*) by placing the edge of the opening of the sock associated with the toe region (2) and hooking the opening edge on the sandal edge associated with the toes. The oval edge opening is positioned on the sole edge (toe or heel) to insure that contact with the edge is maintained when opposite edge of the oval opening (heel or toe) is stretched and hooked on that edge (4 or 2). The edge contact remains in place when the sandal is worn. The toe edge contact and heel edge contact with the edges of the opening to provide a sufficient tension to hold the sock in place on the upper surface of sandal surface. The sock maintains sufficient contact with the sole of the foot to direct moisture away from the foot.

While the invention has been described with an emphasis on preferred embodiments, it will be obvious that variation of the preferred embodiments may be used and that it is intended that the invention may be practiced otherwise than as specifically designed herein. Accordingly, this invention includes all modification encompassed within the spirit and scope of the invention as defined by the claims that follow.

I claim:

1. A sandal sock having heel and toe portions and having an upper planar surface and a lower surface, which said lower surface has a structure that has an opening and sides, where the sides are elastic and define a perimeter with a circumference and where the elastic sides engage with outer edges of a sandal having an upper surface, securing the sandal sock through contact along the circumference of the sandal edge so that the upper planar surface of the sandal sock covers the length and width of the upper surface of the sandal, said sandal having a thong sandal strap attaches to the upper surface of the sandal;

wherein the sandal sock comprises knitted material and wherein the side of the opening has an outer portion and an inner portion where the inner portion connects with the lower sandal sock surface and where the outer portion is capable of contacting the outer edge of the sandal thereby positioning and holding the upper planar sock surface on the upper surface of the sandal, wherein the sandal sock includes a stitched recess with an opening present in the toe region of the sandal sock so that the opening is positioned to receive and accommodate said thong sandal strap, which said stitched recess includes one or more fasteners that adjust the size of the stitched recess and permit closure of the stitched recess opening.

2. The sandal sock of claim 1 wherein the fasteners include hook and loop type fasteners.

3. The sandal sock of claim 2 wherein the hook and loop fasteners securing include Velcro tape.

4. The sandal sock of claim 1 wherein the outer opening edge is in continual contact with the circumference of the sandal edge, when placed.

5. A sandal having a thong sandal strap near the toe region and an upper surface; the thong sandal strap attaches the upper planar surface of the sandal;

where the sandal includes a sandal sock having heel portion and toe portion and having an upper planar surface and a lower surface, which said lower surface has a structure that has an opening and sides where the structure sides are elastic and engage with outer edges of the sandal, where the outer edges of the sandal define a circumference, and where the elastic structure sides secure the sandal sock through contact along a circumference of the sandal, so that the upper planar surface of the sandal sock covers the length and width of the upper surface of the sandal, wherein the sandal sock comprises knitted textile fabric and wherein the side of the opening of the structure has an outer portion and an inner portion where the inner portion connects with the lower sandal sock surface and where the outer portion is elastic and contacts the outer edge of the sandal thereby positioning and holding the upper planar sock surface on the upper surface of the sandal, wherein the sandal sock includes a stitched recess with an opening in the toe region of the sandal sock, which receives and accommodates the thong sandal strap, which the stitched recess includes one or more fasteners that adjust the size of the stitched recess and permit closure of the stitched.

* * * * *